US009289879B2

(12) United States Patent
Copeland et al.

(10) Patent No.: US 9,289,879 B2
(45) Date of Patent: Mar. 22, 2016

(54) HINGE ASSEMBLY FOR AN ANGLE GRINDER DUST SHROUD

(71) Applicant: Black & Decker Inc., Newark, DE (US)

(72) Inventors: Earnest N. Copeland, Abingdon, MD (US); Robert John Cirincione, II, Towson, MD (US)

(73) Assignee: Black & Decker Inc., New Britain, CT (US)

( * ) Notice: Subject to any disclaimer, the term of this patent is extended or adjusted under 35 U.S.C. 154(b) by 0 days.

(21) Appl. No.: 14/264,607

(22) Filed: Apr. 29, 2014

(65) Prior Publication Data

US 2014/0329447 A1 Nov. 6, 2014

Related U.S. Application Data

(60) Provisional application No. 61/818,612, filed on May 2, 2013.

(51) Int. Cl.

| | |
|---|---|
| ***B24B 55/05*** | (2006.01) |
| ***B24B 23/02*** | (2006.01) |
| ***E05F 1/06*** | (2006.01) |
| ***E05F 1/12*** | (2006.01) |
| ***E05D 7/00*** | (2006.01) |

(52) U.S. Cl.

CPC ..... *B24B 55/052* (2013.01); *B24B 23/028* (2013.01); *B24B 55/05* (2013.01); *E05D 7/00* (2013.01); *E05F 1/063* (2013.01); *E05F 1/1223* (2013.01); *Y10T 16/5387* (2015.01)

(58) Field of Classification Search

CPC ..... B24B 55/052; B24B 55/04; B24B 55/05; B24B 23/028; B23Q 11/06; B23Q 11/08; E05F 1/12; E05F 1/1207; E05F 1/1215; E05F 1/1223; E05D 7/08; E05D 7/081; E05D 7/10; E05D 7/1061

USPC ..... 451/451; 16/303

See application file for complete search history.

(56) References Cited

U.S. PATENT DOCUMENTS

| | | | |
|---|---|---|---|
| 496,160 | A | 4/1893 | Keller |
| 57,113 | A | 11/1896 | Hoffman |
| 1,186,294 | A | 6/1916 | Diener |
| 1,270,430 | A | 6/1918 | Martin |
| 2,384,243 | A | 9/1945 | Flohr et al. |

(Continued)

FOREIGN PATENT DOCUMENTS

| | | | |
|---|---|---|---|
| DE | 1068145 | B | 4/1960 |
| DE | 2539762 | C3 | 5/1978 |

(Continued)

OTHER PUBLICATIONS

European Search Report, The Hague Aug. 2014.

*Primary Examiner* — George Nguyen

(74) *Attorney, Agent, or Firm* — Amir R. Rohani; Scott B. Markow

(57) ABSTRACT

A hinge assembly for attaching a door member to a main structure is provided. The hinge assembly, in an embodiment, includes a first hinge member securely attached to one of the door member or the main structure; a second hinge member securely attached to the other of the door member or the main structure and rotatably engaging the first hinge member; and a cam/spring assembly configured to bias the door member into an open or a closed position with respect to the main structure.

18 Claims, 6 Drawing Sheets

(56) References Cited

U.S. PATENT DOCUMENTS

| | | | | | |
|---|---|---|---|---|---|
| 2,735,144 | A | * | 2/1956 | Anderson et al. | 49/237 |
| 2,801,654 | A | | 8/1957 | Utz | |
| 2,968,830 | A | * | 1/1961 | Urtis | 16/248 |
| 3,335,454 | A | * | 8/1967 | Danster, Jr. | 16/278 |
| 3,550,186 | A | * | 12/1970 | Swartz | 16/278 |
| 3,568,241 | A | * | 3/1971 | Uffner | 16/321 |
| 3,673,744 | A | | 7/1972 | Oimoen | |
| 3,837,043 | A | * | 9/1974 | Coe | 16/303 |
| 3,919,890 | A | * | 11/1975 | Workman | 74/89 |
| 3,955,241 | A | * | 5/1976 | Little | 16/298 |
| 3,975,794 | A | * | 8/1976 | Kaiser et al. | 16/303 |
| 4,069,568 | A | | 1/1978 | Sakamoto et al. | |
| 4,215,449 | A | * | 8/1980 | Loikitz | 16/50 |
| 4,607,760 | A | * | 8/1986 | Roche | 220/314 |
| 4,622,782 | A | | 11/1986 | Roestenber | |
| 4,819,298 | A | * | 4/1989 | Lautenschlager | 16/237 |
| 4,921,024 | A | | 5/1990 | Wiemeri et al. | |
| 4,991,259 | A | | 2/1991 | Finkelstein et al. | |
| 5,109,571 | A | * | 5/1992 | Ohshima et al. | 16/307 |
| 5,383,253 | A | * | 1/1995 | Lin | 16/54 |
| 5,546,633 | A | * | 8/1996 | Liu | 16/278 |
| 5,709,597 | A | | 1/1998 | Sarantitis | |
| 6,108,912 | A | | 8/2000 | Radigan | |
| 6,471,574 | B1 | | 10/2002 | Rupprecht et al. | |
| 6,699,114 | B1 | | 3/2004 | Booeshaghi et al | |
| 7,000,289 | B2 | * | 2/2006 | Cedrone | 16/309 |
| 7,596,872 | B2 | | 10/2009 | Clarke et al. | |
| 8,133,094 | B2 | | 3/2012 | Loveless et al. | |
| 8,137,165 | B2 | | 3/2012 | Loveless et al. | |
| 8,438,703 | B2 | * | 5/2013 | Tagtow et al. | 16/334 |
| 8,732,906 | B1 | * | 5/2014 | Van Gennep | 16/229 |
| 8,800,109 | B1 | * | 8/2014 | Mitchell et al. | 16/238 |
| 2001/0004776 | A1 | * | 6/2001 | Fujita | 4/236 |
| 2008/0168667 | A1 | | 7/2008 | Spinato | |
| 2009/0186559 | A1 | | 7/2009 | Loveless et al. | |
| 2010/0275413 | A1 | * | 11/2010 | Kim | 16/303 |
| 2011/0021121 | A1 | | 1/2011 | Loveless et al. | |

FOREIGN PATENT DOCUMENTS

| | | | |
|---|---|---|---|
| DE | 102006041671 | A1 | 3/2008 |
| EP | 1074341 | B1 | 3/2005 |
| EP | 2163344 | A2 | 3/2010 |
| EP | 2163356 | B1 | 2/2011 |
| EP | 2269771 | B1 | 7/2012 |
| FR | 2882949 | | 9/2006 |
| FR | 2882949 | A3 | 9/2006 |

* cited by examiner

HINGE ASSEMBLY FOR AN ANGLE GRINDER DUST SHROUD

CROSS-REFERENCE TO RELATED APPLICATION

This application claims the benefit of U.S. Provisional Patent Application No. 61/818,612 filed May 2, 2013, content of which is incorporated herein by reference in its entirety.

FIELD OF THE INVENTION

The present invention relates to a hinge assembly for a door, and particularly to a hinge assembly for a dust shroud door in an angle grinder.

BACKGROUND AND SUMMARY

Angle grinding tools are commonly used for grinding and sanding applications. Angle grinders include a rotary shaft such as a wheel spindle for driving a grinding wheel mounted thereon. The present disclosure describes an improved shroud for guarding the grinding wheel. The present disclosure also describes a hinge assembly used in the angle grinder shroud.

According to an aspect of the invention a hinge assembly for attaching a door member to a main structure is provided. The hinge assembly, in an embodiment, includes a first hinge member securely attached to one of the door member or the main structure; a second hinge member securely attached to the other of the door member or the main structure and rotatably engaging the first hinge member; and a cam/spring assembly configured to bias the door member into an open or a closed position with respect to the main structure.

In an embodiment, the cam/spring assembly includes a first cam surface defined by a surface of the first hinge member and a second cam surface defined by a surface of the second hinge member and correspondingly engaging the first cam surface. In an embodiment, the first and second cam surfaces cause the second hinge member to move axially with respect to the first hinge member as the door member is rotated with respect to the main structure.

In an embodiment, the cam/spring assembly includes a compression spring having two ends respectively engaging the first and the second hinge members. In an embodiment, the compression spring biases the first and second cam surfaces to engage one another in an open or closed position of the door member with respect to the main structure.

In an embodiment, the first cam surface included a recessed surface and the second cam surface includes a projected surface engaging the recessed surface in the open and closed position of the door member with respect to the main structure.

In an embodiment, the first hinge member engages a first end of the spring and includes a cylindrical portion disposed inside the spring and the second hinge member engages a second end of the spring and includes a channel formed around the spring. In an embodiment, the second hinge member includes two hinge pieces mated together to form the channel around the spring. In an embodiment, the two hinge pieces include alignment features for mating the two hinge pieces together. In an embodiment, the first hinge member includes a second cylindrical portion and the second hinge member includes a second channel formed around the second cylindrical portion, the second cylindrical portion and the second channel not engaging the spring.

According to another aspect of the invention, a hinge assembly for attaching a door member to a main structure is provided. In an embodiment, the hinge assembly includes a first hinge member securely attached to one of the door member or the main structure, the first hinge member defining a first cam surface; a second hinge member securely attached to the other of the door member or the main structure and rotatably engaging the first hinge member, the second hinge member defining a second cam surface corresponding to the first cam surface; and a compression spring having two ends respectively engaging the first and the second hinge members, wherein the compression spring biases the first and second cam surfaces to engage one another in an open or closed position of the door member with respect to the main structure.

In an embodiment, the cam surfaces cause the second hinge member to move axially with respect to the first hinge members as the door member is rotated with respect to the main structure.

In an embodiment, the first cam surface included a recessed surface and the second cam surface includes a projected surface engaging the recessed surface in the open and closed position of the door member with respect to the main structure.

In an embodiment, the first hinge member engages a first end of the spring and includes a cylindrical portion disposed inside the spring and the second hinge member engages a second end of the spring and includes a channel formed around the spring. In an embodiment, the second hinge member includes two hinge pieces mated together to form the channel around the spring.

According to another aspect of the invention, a shroud assembly for an angle grinder having a grinding disc is provided. In an embodiment, the shroud assembly is configured to enclose the grinding disc and includes a shroud body; a shroud door rotatably attached to the shroud body to expose a portion of the grinding disc; and a hinge assembly disposed between the shroud body and the shroud door. In an embodiment, the hinge assembly includes a first hinge member securely attached to the shroud body; a second hinge member securely attached to the shroud door and rotatably engaging the first hinge member; and a cam/spring assembly configured to bias the shroud door into an open or a closed position with respect to the shroud body.

In an embodiment, the cam/spring assembly includes a first cam surface defined by a surface of the first hinge member and a second cam surface defined by a surface of the second hinge member and correspondingly engaging the first cam surface. In an embodiment, the first and second cam surfaces cause the second hinge member to move axially with respect to the first hinge member as the shroud door is rotated with respect to the shroud body. In an embodiment, the cam/spring assembly includes a compression spring having two ends respectively engaging the first and the second hinge members. In an embodiment, the compression spring biases the first and second cam surfaces to engage one another in an open or closed position of the door member with respect to the main structure.

DESCRIPTION

List of References

Figure 1:
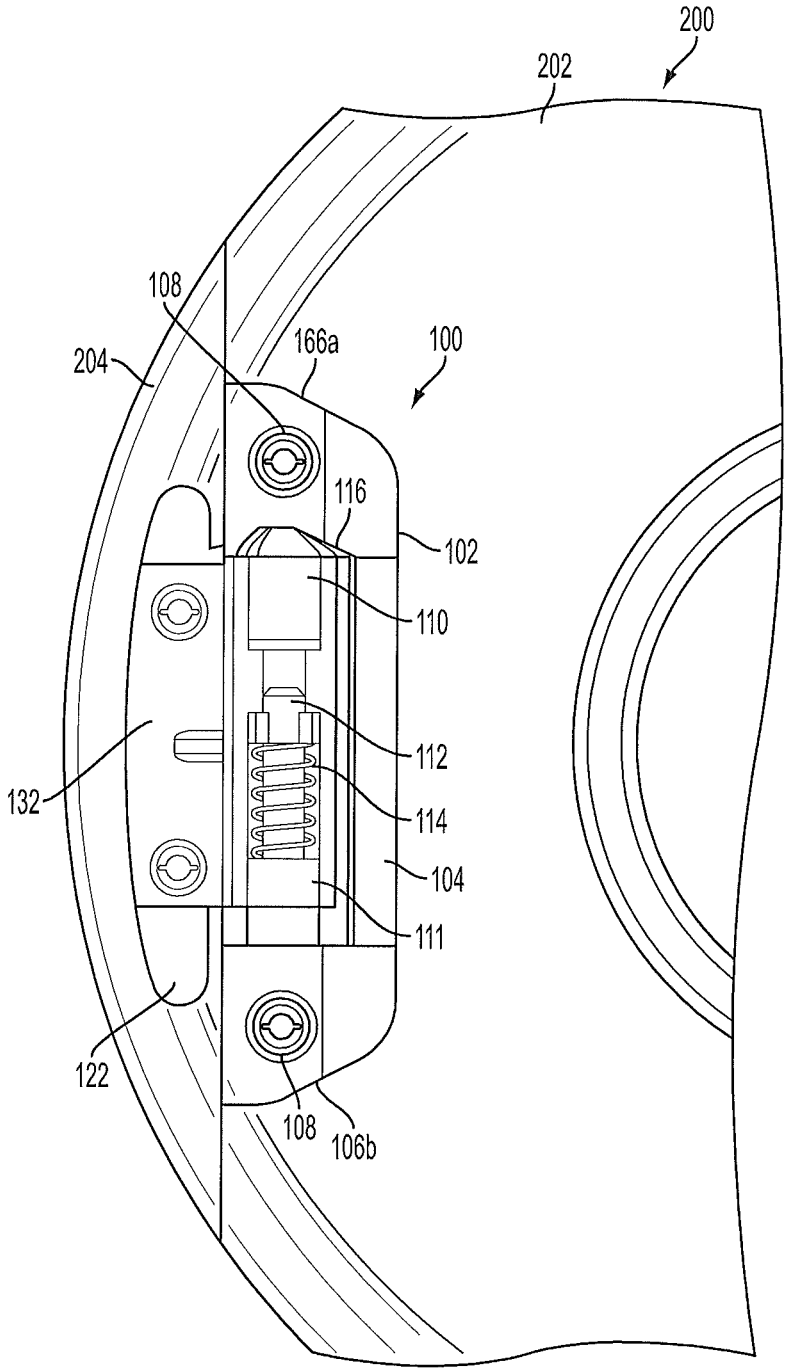
FIG. 1 depicts a partial view of a dust shroud for an angle grinder, according to an embodiment of the invention.

100 hinge assembly
102 shroud-side hinge member
104 elongated member
106*a* first shroud attachment member
106*b* second shroud attachment member
108 hole
110 first cylindrical member
111 second cylindrical member
112 stepped cylindrical (i.e., pin-shaped) member
114 spring
116 recessed cam surface
122 first door-side hinge member
123 hole
124 second channel
126 third channel
128 first channel
130 outwardly-projecting cam surface
132 second door-side hinge member
133 hole
134 second channel
136 third channel
138 first channel
140 outwardly-projecting cam surface
152 projections
154 recesses
200 shroud
202 shroud body
204 shroud door Reference is made to U.S. Pat. No. 8,388,417, issued Mar. 5, 2013, which is incorporated herein by reference in its entirety, for a detailed description of an angle grinder construction. The present disclosure describes a shroud for protecting and guarding the grinding wheel. It is noted that the shroud described herein may be used with any type of grinder regardless of size.

Dust shrouds are used in a variety of power tools to keep dust and debris away from the user. Dust shrouds also protect the user from inadvertent contact with the grinding wheel. Some conventional guards only partially cover an arcural portion of the grinding wheel, leaving a portion of the grinding wheel edge exposed.

The shroud of the present invention, according to an embodiment, fully encloses an upper surface and circumferential edges of the grinding wheel. In an embodiment, the shroud includes a side door to partially expose an edge of the grinding wheel. In an embodiment, the shroud door includes a hinge that allows the user to optionally open or close the door. The door extends from the shroud body to fully enclose the grinding wheel in the closed position. When the door is opened, it lifts above a portion of the grinding wheel to partially expose an edge and upper surface of the grinding wheel. In an embodiment, the hinge utilizes a cam/spring mechanism to bias the shroud in the open or closed position.

FIGS. 1-5 depict a shroud 200 including a shroud body 202 and a shroud door 204 attached to the shroud body 202 via a hinge assembly 100 including a cam/spring mechanism, according to an embodiment. In an embodiment, hinge assembly 100 includes a shroud-side hinge member 102 secured to the shroud body 202, and two-piece door-side hinge members 122 and 132 secured to the shroud door 204.

Figure 2:
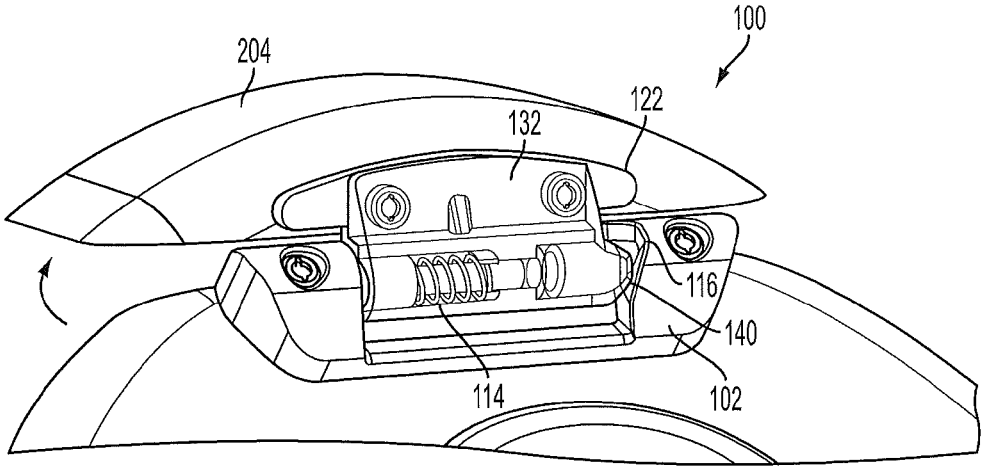
FIG. 2 depicts a perspective view of a hinge assembly for attaching a shroud door to the shroud body, according to an embodiment.
Figure 3:
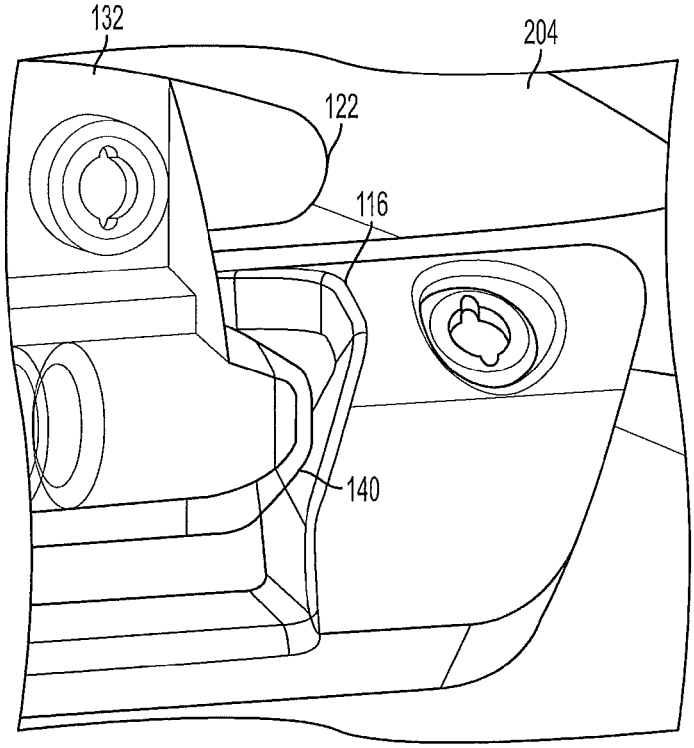
FIG. 3 depicts a zoomed-in view of FIG. 2 showing a cam system of the hinge assembly, according to an embodiment.
Figure 4:
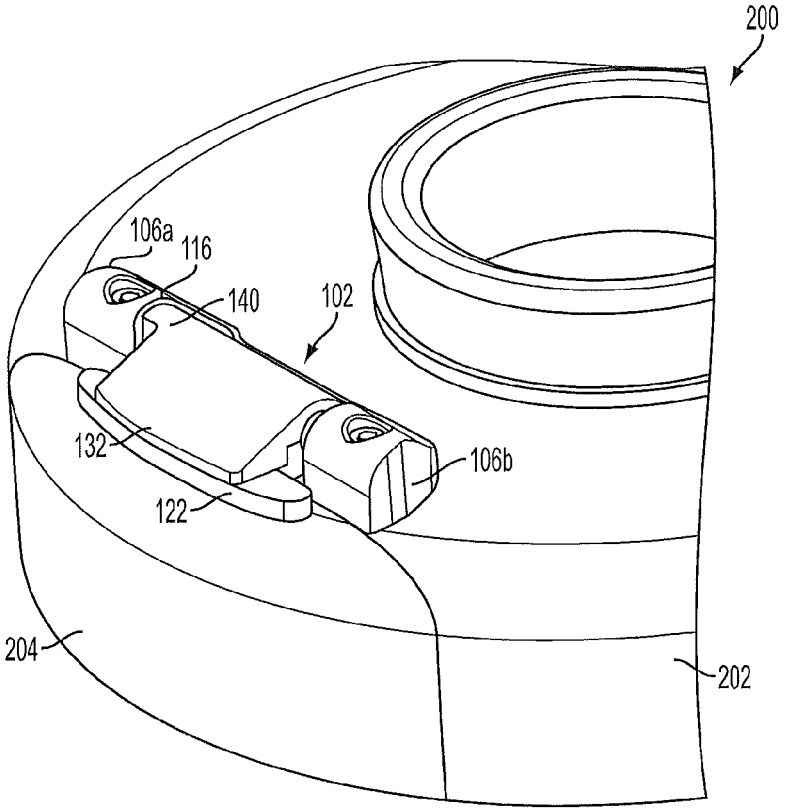
FIG. 4 depicts a perspective view of the hinge assembly and shroud door in the closed position, according to an embodiment.
Figure 5:
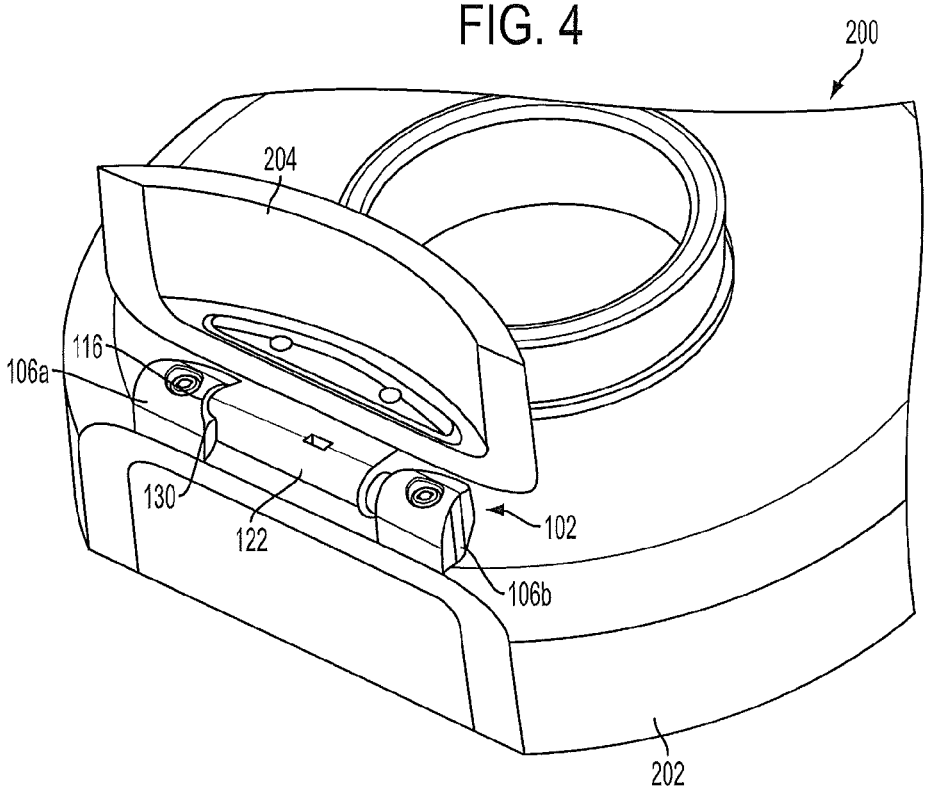
FIG. 5 depicts a perspective view of the hinge assembly and shroud door in the open position, according to an embodiment.
Figure 6:
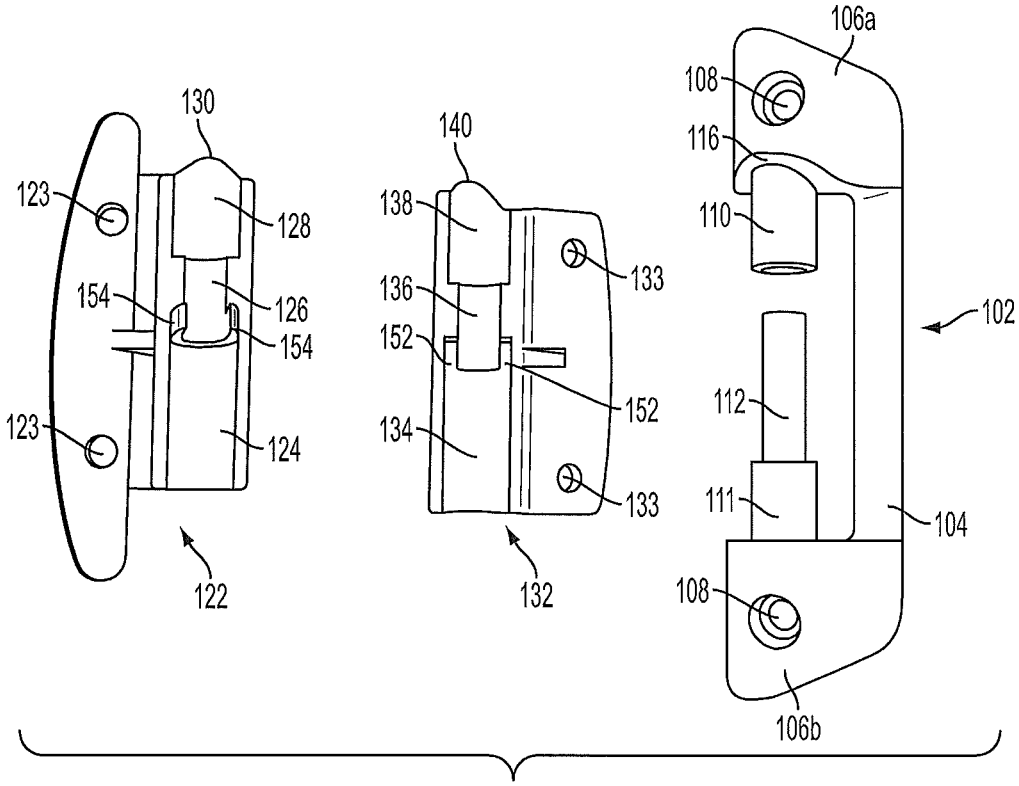
FIG. 6 depicts an expanded view of the hinge assembly, according to an embodiment.
Figure 7:
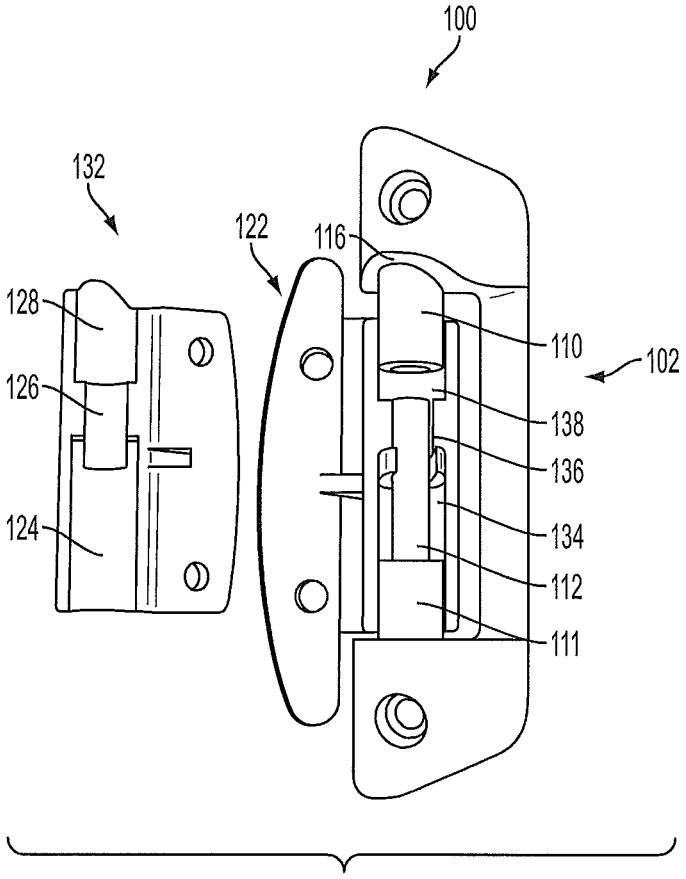
FIG. 7 depicts a partial expanded view of the hinge assembly, according to an embodiment.
Figure 8:
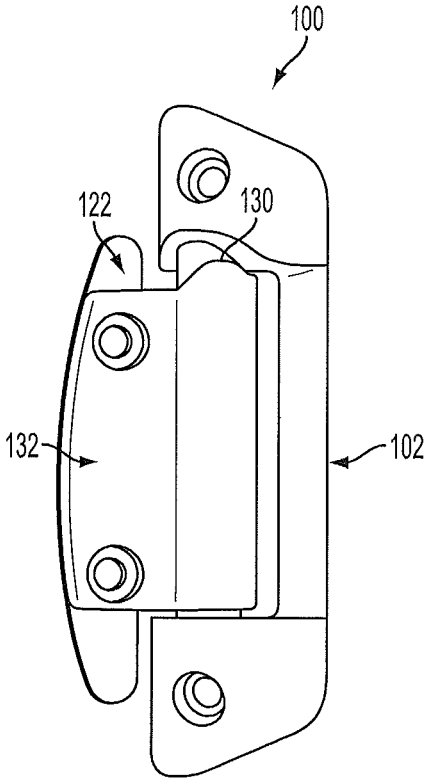
FIG. 8 depicts an assembly view of the hinge assembly, according to an embodiment.

The construction of the hinge is discussed herein with reference to FIGS. 1-5, and further with reference to FIGS. 6-8, according to an embodiment of the invention. FIGS. 1-5 depict various views of the hinge assembly 100 mounted on the shroud 200. In FIGS. 1-3, first and second door-side hinge members 122 and 132 are shown in clear plastic for illustration purposes to make the internal components of the hinge assembly 100 visible. FIGS. 4 and 5 depict the shroud door 204 in closed and open positions, respectively. FIGS. 6-8 depict expanded views of the hinge assembly 100 components, according to an embodiment.

Shroud-side hinge member 102, in an embodiment, includes an elongated member 104 and two shroud attachment members 106*a* and 106*b* disposed at two ends of the elongated member 104. First and second shroud attachment members 106*a* and 106*b* include holes 108 used to secure the shroud-side hinge 102 to the shroud body 202 via pins and/or screws. Between attachment members 106*a* and 106*b*, and parallel to elongated member 104, first and second cylindrical members 110 and 111 extend towards each other from first and second shroud attachment members 106*a* and 106*b*. First shroud attachment member 106*a* includes two recessed cam surfaces 116 around the periphery of the first cylindrical member 110. The second cylindrical member 111 includes a stepped cylindrical member (also referred to as pin-shaped member) 112 having a smaller diameter that the second cylindrical member 111. The pin-shaped member 112 extends from the second cylindrical member 111 towards and substantially close to the first cylindrical member 110.

In an embodiment, the first and second door-side hinge members 122 and 132 mate together around cylindrical members 110 and 111 of shroud-side hinge member 102. The door-side hinge members 122 and 132 include matching holes 123 and 133 for attachment to the shroud door 204 via pins and/or screws.

In an embodiment, the door-side hinge members 122 and 132 include first channels 128 and 138, respectively, which mate together around first cylindrical portion 110 of the shroud-side hinge member 102. An upper portion of each of the first channels 128 and 138 includes outwardly-projecting cam surfaces 130 and 140 that engage two corresponding recessed cam surfaces 116 of the shroud attachment member 106*a*. Cam surfaces 130 and 140 have the same profile as recessed cam surfaces 116, allowing the door-side hinge members 122 and 132 to move up and down as the shroud door 204 is turned about the hinge.

In an embodiment, the door-side hinge members 122 and 132 also include second channels 124 and 134, respectively, which mate together around second cylindrical portion 111 and spring 114 of shroud-side hinge member 102. The door-side hinge members 122 and 132 further each include narrower third channels 126 and 136, respectively, which are indented with respect to the second channels 124 and 134. Third channels 126 and 136 mate together around the pin-shaped member 112 of the shroud-side hinge member 102. In an embodiment, projections 152 and recesses 154 are provided around the third channels 126 and 136, respectively.

Projections 152 fit into recesses 154 for proper alignment of the first and second door-side hinge members 122 and 132, yet together form a circular channel around the pin-shaped member 112.

According to an embodiment, an axial compression spring 114 is arranged around the pin-shaped member 112. A first end of the spring 114 rests against a wall of the second cylindrical member 111 of the shroud-side hinge member 102. A second end of the spring 114 engages a wall formed by the third channels 126 and 136 of the door-side hinge members 122 and 132. The spring 144 biases the door-side hinge members 122 and 132 towards the first shroud attachment member 106*a*, forcing projecting cam surfaces 130 and 140 into the corresponding recessed cam surfaces 116 in the open and closed positions of the shroud door 204.

FIG. 2 depicts the hinge assembly 100 as the shroud door 204 is opened (i.e., rotated from a closed position to an open position), according to an embodiment. FIG. 3 depicts a zoomed-in view of FIG. 2, showing the engagement of the cam surfaces 140 and 116 as the shroud door 204 is opened.

FIG. 4 depicts a perspective view of the shroud 200 as the shroud door 204 is fully closed, according to an embodiment. FIG. 5 depicts a perspective view of the shroud 200 as the shroud door 204 is fully opened. In this embodiment, when the shroud door 204 is closed, projected cam surface 130 and 140 of the door-side hinge members 122 and 132 engages the mating recessed cam surfaces 116 of the shroud-side hinge member 102 (only one of which can be seen). As the door is opened, cam surfaces 130 and 140 of the door-side hinge members 122 and 132 disengage the mating cam surfaces 116 of the shroud-side hinge member 102. In the meantime door-side hinge members 122 and 132 are pushed closer to the second shroud attachment member 106*b* and spring 114 is compressed. As the door is opened further, the door-side hinge members 122 and 132 continue to pivot until cam surfaces 130 and 140 once again engage door-side cam surfaces 116 in the open position. Spring 114 biases the shroud door 204 to remain in the open position until once again forced closed by the user.

As previously discussed, FIG. 6 depicts an expanded view of the hinge assembly 100, including the shroud-side hinge member 102, and door-side hinge members 122 and 132, according to an embodiment. FIG. 7 depicts the first door-side hinge member 122 engaging the shroud-side hinge member 102, in an embodiment. Spring 114 is excluded from this view. As shown in this figure, first and second channels 138 and 134 partially enclose first and second cylindrical members 110 and 111. FIG. 8 depicts the full hinge assembly 100 including the two door-side hinge members 122 and 132 mating, according to an embodiment.

The above description is for a hinge assembly used for a shroud door in an angle grinder, according to an exemplary embodiment of the invention. It is noted that hinge assembly of the present application may be used in various type of application or devices, such as home appliances, storage sheds, etc., where it is desired to attach a door to a main body or a support structure biasedly in an open or closed position. It is further noted that while the door-side hinge members 122 and 132 are illustratively depicted as two separate members mated together, the door-side hinge member may be made of a single piece. It is further noted that the shroud-side hinge member and the door-side hinge member may be switched, so that the door-side hinge member includes cylindrical portions for accommodating the spring, and the shroud-side hinge member includes the cylindrical members to house around the spring. Moreover, it is noted that the shroud-side hinge member may be provided with a projected cam surface and the door-side hinge member with a corresponding recessed cam surface.

The invention claimed is:

1. A hinge assembly for attaching a door member to a main structure, comprising:

a first hinge member securely attached to one of the door member or the main structure;

a second hinge member securely attached to the other of the door member or the main structure and rotatably engaging the first hinge member; and a cam/spring assembly configured to bias the door member into an open or a closed position with respect to the main structure, the cam/spring assembly comprising a compression spring having two ends respectively engaging the first and the second hinge members.

2. The hinge assembly of claim 1, wherein the cam/spring assembly includes a first cam surface defined by a surface of the first hinge member and a second cam surface defined by a surface of the second hinge member and correspondingly engaging the first cam surface.

3. The hinge assembly of claim 2, wherein the first and second cam surfaces cause the second hinge member to move axially with respect to the first hinge member as the door member is rotated with respect to the main structure.

4. The hinge assembly of claim 2, wherein the compression spring biases the first and second cam surfaces to engage one another in an open or closed position of the door member with respect to the main structure.

5. The hinge assembly of claim 2, wherein the first cam surface included a recessed surface and the second cam surface includes a projected surface engaging the recessed surface in the open and closed position of the door member with respect to the main structure.

6. The hinge assembly of claim 2, wherein the first hinge member engages a first end of the spring and includes a cylindrical portion disposed inside the spring and the second hinge member engages a second end of the spring and includes a channel formed around the spring.

7. The hinge assembly of claim 6, wherein the second hinge member includes two hinge pieces mated together to form the channel around the spring.

8. The hinge assembly of claim 7, wherein the two hinge pieces include alignment features for mating the two hinge pieces together.

9. The hinge assembly of claim 6, wherein the first hinge member includes a second cylindrical portion and the second hinge member includes a second channel formed around the second cylindrical portion, the second cylindrical portion and the second channel not engaging the spring.

10. A hinge assembly for attaching a door member to a main structure, comprising:

a first hinge member securely attached to one of the door member or the main structure, the first hinge member defining a first cam surface;

a second hinge member securely attached to the other of the door member or the main structure and rotatably engaging the first hinge member, the second hinge member defining a second cam surface corresponding to the first cam surface; and a compression spring having two ends respectively engaging the first and the second hinge members, wherein the compression spring biases the first and second cam surfaces to engage one another in an open or closed position of the door member with respect to the main structure.

11. The hinge assembly of claim 10, wherein the cam surfaces cause the second hinge member to move axially with respect to the first hinge members as the door member is rotated with respect to the main structure.

12. The hinge assembly of claim 10, wherein the first cam surface included a recessed surface and the second cam surface includes a projected surface engaging the recessed surface in the open and closed position of the door member with respect to the main structure.

13. The hinge assembly of claim 10, wherein the first hinge member engages a first end of the spring and includes a cylindrical portion disposed inside the spring and the second hinge member engages a second end of the spring and includes a channel formed around the spring.

14. The hinge assembly of claim 13, wherein the second hinge member includes two hinge pieces mated together to form the channel around the spring.

15. A shroud assembly for an angle grinder having a grinding disc, the shroud assembly configured to enclose the grinding disc, the shroud assembly comprising:

a shroud body;

a shroud door rotatably attached to the shroud body to expose a portion of the grinding disc; and a hinge assembly disposed between the shroud body and the shroud door, the hinge assembly including:

a first hinge member securely attached to the shroud body;

a second hinge member securely attached to the shroud door and rotatably engaging the first hinge member; and a cam/spring assembly configured to bias the shroud door into an open or a closed position with respect to the shroud body, wherein the cam/spring assembly comprises a compression spring having two ends respectively engaging the first and the second hinge members.

16. The shroud assembly of claim 15, wherein the cam/spring assembly includes a first cam surface defined by a surface of the first hinge member and a second cam surface defined by a surface of the second hinge member and correspondingly engaging the first cam surface.

17. The shroud assembly of claim 16, wherein the first and second cam surfaces cause the second hinge member to move axially with respect to the first hinge member as the shroud door is rotated with respect to the shroud body.

18. The shroud assembly of claim 17, wherein the compression spring biases the first and second cam surfaces to engage one another in an open or closed position of the door member with respect to the main structure.

* * * * *